US005870998A

United States Patent [19]

Ma

[11] Patent Number: 5,870,998

[45] Date of Patent: Feb. 16, 1999

[54] MIXTURE PREPARATION IN A SPARK IGNITED ENGINE

[75] Inventor: Thomas Tsoi-Hei Ma, South Woodham Ferrers, United Kingdom

[73] Assignee: Ford Global Technologies, Inc., Dearborn, Mich.

[21] Appl. No.: 394

[22] PCT Filed: Aug. 5, 1996

[86] PCT No.: PCT/GB96/01897

§ 371 Date: Jan. 21, 1998

§ 102(e) Date: Jan. 21, 1998

[87] PCT Pub. No.: WO97/08455

PCT Pub. Date: Mar. 6, 1997

[30] Foreign Application Priority Data

Aug. 26, 1995 [GB] United Kingdom ..... 9517539

[51] Int. Cl.[6] ..... F02M 23/00

[52] U.S. Cl. ..... 123/532

[58] Field of Search ..... 123/531–533

[56] References Cited

U.S. PATENT DOCUMENTS

| | | | |
|---|---|---|---|
| 1,261,466 | 4/1918 | Weiss | 123/532 |
| 4,716,877 | 1/1988 | Duret | 123/532 |
| 4,771,754 | 9/1988 | Weiss | 123/532 |
| 5,027,765 | 7/1991 | Duret | 123/532 |
| 5,095,881 | 3/1992 | Nishimura et al. | 123/532 |
| 5,390,647 | 2/1995 | Schechter | 123/532 |

FOREIGN PATENT DOCUMENTS

| | | | |
|---|---|---|---|
| 593837 | 9/1925 | France | 123/532 |
| 975530 | 11/1962 | United Kingdom . | |
| 2195707 | 9/1987 | United Kingdom . | |

*Primary Examiner*—Erick R. Solis
*Attorney, Agent, or Firm*—Neil P. Ferraro

[57] ABSTRACT

An internal combustion engine is described having one or more combustion chambers 10 each having an intake port 16, a fuel injector assembly 30 for injecting fuel into the intake port 16 and means 20, 22, 24, 26 for supplying pressurised gas to assist in fuel atomisation of the fuel metered through the fuel injector assembly 30.

The means for supplying pressurised gas comprises a passage 20, 24 incorporating a passive flow restrictor 22 having no moving elements. The passage 20, 24 leads from one of the combustion chambers 10 of the engine to the intake port 16 and is operative to deliver a single pulse of gas to the intake port 16 during each combustion cycle of the engine in order to assist in the atomisation of fuel which is injected into the intake port 16 at the same time as the pulse of gas.

3 Claims, 1 Drawing Sheet

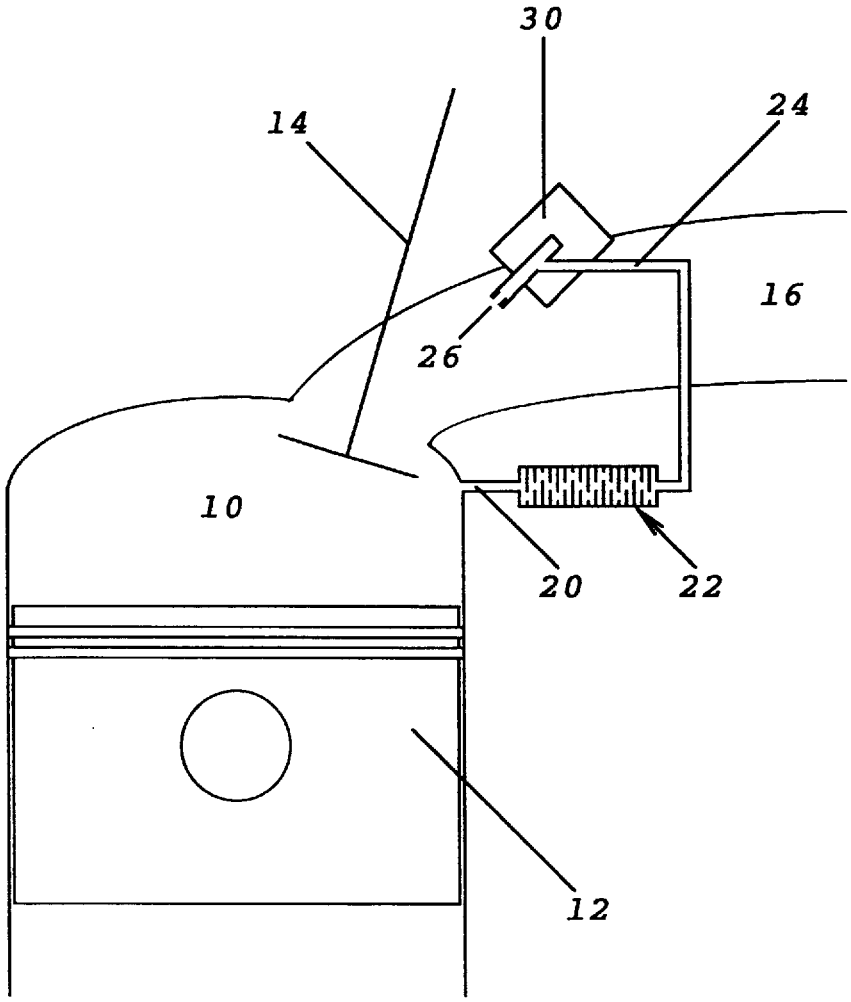
30
14
24
16
26
10
20
22
12

MIXTURE PREPARATION IN A SPARK IGNITED ENGINE

FIELD OF THE INVENTION

The present invention relates to an internal combustion engine having one or more combustion chambers each having an intake port, a fuel injector for injecting fuel into the intake port and means for supplying pressurised gas to assist in fuel atomisation of the fuel metered through the fuel injector.

BACKGROUND OF THE INVENTION

Fuel injection systems with air assisted fuel injection to improve fuel atomisation are well known. The gas supply to the injectors has in the past been drawn from a variety of sources. In the simplest form of such systems, ambient air is used to assist atomisation and is drawn into the intake port near to the fuel jet by the manifold vacuum. Such a system can only be used under low load conditions when the intake manifold vacuum is high and is not effective under high engine load conditions.

Other systems have been proposed that use gas from a rail that is pressurised in some manner when the engine is in operation. The rail can be pressurised by an engine driven compressor or by connecting it through one-way valves to the engine combustion chambers. In the latter case, the pressure in the rail may be too high, in which case a regulator is needed to reduce the delivery pressure of the gas to the intake ports.

The disadvantages with such systems is that the rail is permanently under pressure and delivers gas continuously to the intake ports, even at times when it is not required. As drawing gas from the combustion chambers of the engine or using the engine to drive a compressor both take power from the engine, this continuous supply of gas amounts to a waste of energy that increases fuel consumption.

One can use timed ON/OFF valves to limit the supply of gas from the compressed gas rail to the intake ports to the instants when it is required for fuel atomisation, but this increases system complexity and cost.

OBJECTIVE OF THE INVENTION

The present invention therefore seeks to provide an engine in which gas for assisting in fuel atomisation may be provided intermittently in an inexpensive and energy efficient manner.

SUMMARY OF THE INVENTION

In accordance with a first aspect of the present invention, there is provided an internal combustion engine having one or more combustion chambers each having an intake port, a fuel injector for injecting fuel into the intake port and means for supplying pressurised gas to assist in fuel atomisation of the fuel metered through the fuel injector, characterised in that the means for supplying pressurised gas comprises a passage incorporating a passive flow restrictor having no moving elements, the passage leading from one of the combustion chambers of the engine to the intake port and being operative to deliver a single pulse of gas to the intake port during each combustion cycle of the engine in order to assist in the atomisation of fuel injected into the intake port at the same time as the pulse of gas.

According to an alternative aspect of the invention, there is provided an internal combustion engine wherein each combustion chamber of the engine is connected to an intake port via a passage passing through the wall of the combustion chamber, the passage containing at least one passive flow restricting element to permit flow of gas in either direction driven by pressure pulses in the combustion chamber, and being operative to supply a pulse of gas into the intake port once during each combustion cycle to assist in fuel atomisation.

The invention differs from the prior art proposals using a pressurised rail in that the passages connecting the combustion chambers to the intake ports are all separate and not combined into a common supply rail. Furthermore, the individual passages do not contain a large buffer volume that would tend to even out the pressure pulses from the engine combustion cycles but instead make use of these dynamic pressure pulses to provide a pulsed gas supply to the intake ports. It is also important to note that the passage in the invention contains only passive components and has no moving parts. This not only reduces cost and complexity but also ensures long term reliability.

The volume of the passage between the flow restricting element and the intake port and the rate of discharge of gas out of the passage into the intake port should preferably be such that the pressure in the passage during at least part of the intake period of each engine cycle is substantially the same as the pressure in the intake port. This ensures that gas flow only occurs in pulses to atomise the fuel and no gas is introduced into the intake port between the pulses, at times when it is not needed and merely wastes energy.

Because of the high peak pressures in the combustion chambers, flow restrictors are required in the passages to limit the volume of gas that is delivered during each combustion cycle of the engine to assist the fuel injectors. The flow restrictors may take the form of a single orifice or a long capillary tube but both these risk being blocked by deposits after prolonged engine use. It is therefore preferred to use a plurality of fluidic diodes in series with one another as flow restrictors. A restrictor formed in this way, and that is commercially available as a Lee Visco Jet, can have a minimum flow area some twenty five times greater than a single orifice offering the same flow resistance and is therefore less prone to blockage. Typically, the minimum flow diameter of the fluidic diode may be of the order of 1 to 1.5 mm, this being sufficiently large to allow any particle from the combustion chamber to pass through it without creating an obstruction.

BRIEF DESCRIPTION OF THE DRAWINGS

The invention will now be described further, by way of example, with reference to the accompanying drawing, which shows schematically a section through a cylinder of an internal combustion engine of the invention.

DETAILED DESCRIPTION OF THE PREFERRED EMBODIMENT

The single figure shows a section through a cylinder of an engine comprising a piston 12 and a combustion chamber 10. The intake valve 14, shown in its open position, is supplied with air through an intake port 16 into which fuel is injected by an air-assisted fuel injector assembly 30 having a discharge nozzle 26. Fuel introduced into the nozzle 26 is sprayed into the intake port 16 in the direction of the intake valve 14 by pressurised gas that is supplied as discrete pulses to the nozzle 26. This gas is drawn from the clearance volume of the combustion chamber 10 by a passage 20 and flows to the nozzle 26 through a flow restrictor 22 and a second passage 24.

Instead of the fuel and the pressurised gas sharing a common nozzle 26, it is possible for the passage 24 to blow gas across the mouth of a fuel injector to produce the desired atomisation of the fuel.

It is in all cases important that the volume of the passage 24 should not be so great in relation to the flow rate of gas through it that it would act as a buffer. In other words, it is important that at the end of each gas pulse, the pressure in the passage 24 should drop to the same level as the pressure in the intake port 16.

The flow restrictor 22 is formed as a series of fluidic diodes each of which consists of two plates of which one has an eccentric tangential aperture and the other a central aperture. The apertures are shaped such that the gas flow in the chamber between the plates follows an extended spiral path when passing from the tangential aperture to the central aperture. This form of flow restrictor can offer high resistance to flow while still having a sufficient minimum flow diameter to avoid it being blocked by deposits.

Fluidic diodes, as the name implies, have a preferred direction of flow, but in the present invention they are connected in series with one another with alternately reversed polarity so that the restrictor offers equal resistance to flow in both directions.

In operation, a surge of pressurised gas will flow into the intake port 16 during only the part of each engine cycle when the pressure in the combustion chamber is significantly higher than the pressure in the intake port. The gas flow will stop during the remaining part of each engine cycle when the pressure in the combustion chamber is substantially the same as the pressure in the intake port.

During the intake period of the engine cycle, when the intake valve 14 is open as illustrated in FIG. 1, both the passages 24 and 20 are fully discharged and are returned to the pressure prevailing in the intake port and in the combustion chamber.

The content of the pulse of gas supplied to the intake port may consist of air, fuel and air mixture, and/or burnt gases. During the compression and combustion periods of the engine cycle, these gases are compressed in sequence into the passage 20. The proportions of these gases are dependent upon the position of the passage 20 in relation with the spark plug and the timing of the arrival of the flame front at the passage 20. Preferably, the passage 20 should open into the combustion chamber near the edge of the combustion chamber to ensure that the pulse of gas contains a large proportion of fuel and air mixture and a small proportion of burnt gases. This minimises the amount of recirculated burnt gases in the subsequent cycle and avoids combustion instability.

During the expansion phase of the engine cycle, the last part of the burnt gases to be compressed into the passage 20 will again expand and return to the combustion chamber from the passage 20. This does not have a detrimental effect on the performance of the engine cycle nor the emissions discharged in the exhaust feed gases.

There will be a time delay between the peak pressure in the combustion chamber and the peak gas flow into the intake port. This delay will be a fixed time delay and the timing of the pulse of gas expressed in crank angles with reference to the combustion cycle will therefore be speed dependent. This effect can however be calculated and it is possible nevertheless to time the injection of the fuel in the fuel injector to coincide with the arrival of the pulse of gas through the passage 24.

Fuel injection may be introduced earlier but kept within the fuel injector waiting for a subsequent pulse of gas to force it out of the fuel injector into the intake system.

Relatively high gas pressure can be generated within the passage during the gas pulse. By suitably selecting the resistance of the flow restricting element 22, the pressure pulse in the passage can be set to an acceptable level, preferably between 2–6 bar.

In a multi-cylinder engine, each passage may lead from a combustion chamber to its own intake port or to the intake port of another cylinder.

If the passage is connected to the intake port of the same cylinder, the atomised fuel is always introduced into the intake port during the part of the engine cycle when the intake valve of the cylinder is closed. In this case, the connecting passages to the fuel injectors are short and they are of equal length for all cylinders.

If the passage is connected to the intake port of another cylinder, the atomised fuel may be introduced into the intake port during the part of the engine cycle when the intake valve of the cylinder is open. In this case, care should be taken to ensure that the connecting passages are of equal length to each fuel injector, and that the longer lengths of the connecting passages are sufficiently small in volume to discharge completely during every engine cycle.

I claim:

1. An internal combustion engine having at least one combustion chamber each having an intake port and a fuel injector for injecting fuel into the intake port, with said engine comprising: a passage incorporating a passive flow restrictor for supplying pressurized gas to assist in fuel atomisation of metered fuel through said fuel injector, with said passage having no moving elements, with said passage leading from a combustion chamber of the engine to the intake port and being operative to deliver a single pulse of gas to the intake port during each combustion cycle of the engine in order to assist in the atomisation of fuel injected into the intake port at the same time as the pulse of gas, with said flow restrictor comprising a plurality of serially connected fluidic diodes, wherein consecutive serially connected fluidic diodes are connected with reverse polarity, whereby said flow restrictor offers equal resistance to flow in both directions.

2. An internal combustion engine having a combustion chamber connected to an intake port, with said engine comprising a passage passing through a wall of the combustion chamber and a wall of the intake port, with said passage containing at least one passive flow restricting element to permit flow of gas in either direction driven by pressure pulses in the combustion chamber, and being operative to supply a pulse of gas into the intake port once during each combustion cycle to assist in fuel atomisation, with said flow restricting element comprising a plurality of serially connected fluidic diodes, wherein consecutive serially connected fluidic diodes are connected with reverse polarity, whereby said flow restricting element offers equal resistance to flow in both directions.

3. An internal combustion engine as claimed in claim 2, wherein a volume of said passage between said flow restricting element and the intake port and a rate of discharge of gas out of said passage into the intake port is such that pressure in said passage during at least part of an intake period of each engine cycle is substantially the same as the pressure in the intake port.

* * * * *